United States Patent [19]

Gill et al.

[11] Patent Number: 4,990,290

[45] Date of Patent: Feb. 5, 1991

[54] DIFFUSION FOGGER

[76] Inventors: James G. Gill; Martin J. Becker, both of 5300 Melrose Ave., Suite 201D, Hollywood, Calif. 90038

[21] Appl. No.: 511,947

[22] Filed: Apr. 16, 1990

Related U.S. Application Data

[63] Continuation of Ser. No. 348,775, May 8, 1989, abandoned.

[51] Int. Cl.[5] ..... B01F 3/04

[52] U.S. Cl. ..... 261/30; 261/78.2; 261/DIG. 65; 261/116; 239/590; 55/518; 55/482

[58] Field of Search ..... 239/338, 343, 590; 55/482, 518; 261/78.2, 30, DIG. 65, 116

[56] References Cited

U.S. PATENT DOCUMENTS

| | | | |
|---|---|---|---|
| 1,358,084 | 11/1920 | Leigh | 261/78.2 |
| 1,895,765 | 1/1933 | Muller . | |
| 2,651,172 | 9/1953 | Kennedy | 239/590 |
| 2,809,073 | 10/1957 | Wahlert | 239/590 |
| 2,887,181 | 5/1959 | Dillon | 239/343 |
| 2,913,184 | 11/1959 | Parlin | 261/116 |
| 3,111,273 | 11/1963 | Mei | 239/343 |
| 3,207,386 | 9/1965 | Presant et al. . | |
| 3,249,553 | 5/1966 | Steinberg | 261/78.2 |
| 3,302,374 | 2/1967 | Szekely | 261/78.2 |
| 3,348,825 | 10/1967 | McIlvaine | 261/116 |
| 3,349,042 | 10/1967 | Andrews . | |
| 3,419,658 | 12/1968 | Saunders . | |
| 3,499,723 | 3/1970 | Hamilson et al. . | |
| 3,672,126 | 6/1972 | Goettle | 261/116 |
| 3,739,555 | 6/1973 | Liebig | 55/518 |
| 3,954,921 | 5/1976 | Yoshida et al. | 261/78.2 |
| 4,063,900 | 12/1977 | Mita et al. | 55/518 |
| 4,068,802 | 1/1978 | Goings | 261/116 |
| 4,116,387 | 9/1978 | Kremer, Jr. et al. | 261/DIG. 65 |
| 4,271,100 | 6/1981 | Trassy | 261/78.2 |
| 4,301,674 | 11/1981 | Haines . | |
| 4,326,119 | 4/1982 | Swiatosz . | |
| 4,330,422 | 5/1982 | Tesch . | |
| 4,396,372 | 8/1983 | Matumoto et al. | 261/116 |
| 4,836,452 | 6/1989 | Fox | 239/338 |

*Primary Examiner*—Tim Miles

*Attorney, Agent, or Firm*—James Creighton Wray

[57] ABSTRACT

A diffusion fogger is packed on a road case. Fans draw air through a baffle chamber and through fan openings into a fan chamber, an air compressor above the fan chamber provides compressed air to a fog head assembly. The fog head assembly releases an oil mist fog into a fog duct. Air from the fan chamber is blown through the duct and out through a front opening, entraining and delivering the fog. Air from the fan chamber is circulated over a path that serves to cool the compressor, compressed air, and exhausts from the outlet ducts. The fog head is a removable vertical assembly of an oil sump chamber and a nozzle array chamber. The nozzles, with inlets to an air manifold draw up filtered oil from an oil manifold and spray a fine mist of oil and decompressed air into the nozzle chamber. The mist continues through the next above baffle box filled with marbles, removing large oil droplets. Oil collected by the marbles drains through the nozzle chamber into the sump, and the mist continues upward and horizontally through the top filter chamber, which has a foam filter. The mist is exhausted into the mist duct, where it is entrained in the air delivered by the fans which carries the fog to the desired location. The fog head and mist duct are located in a vertically hinged door on the road case.

24 Claims, 7 Drawing Sheets

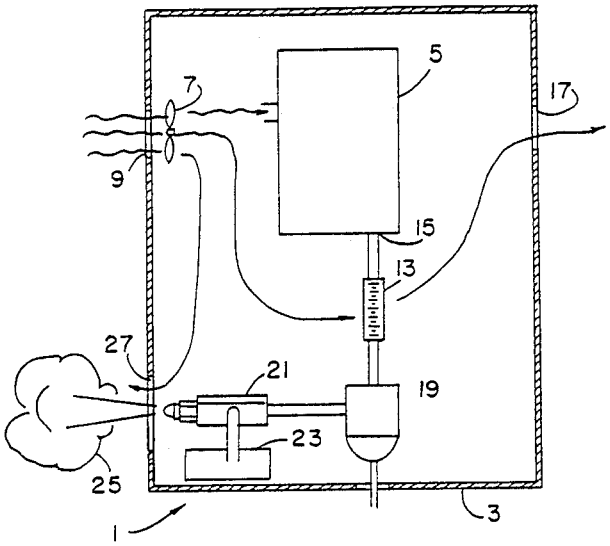
FIG. 1
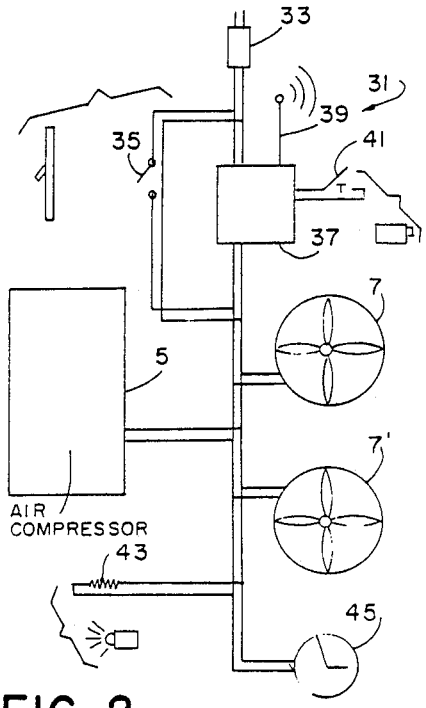
FIG. 2
FIG. 3
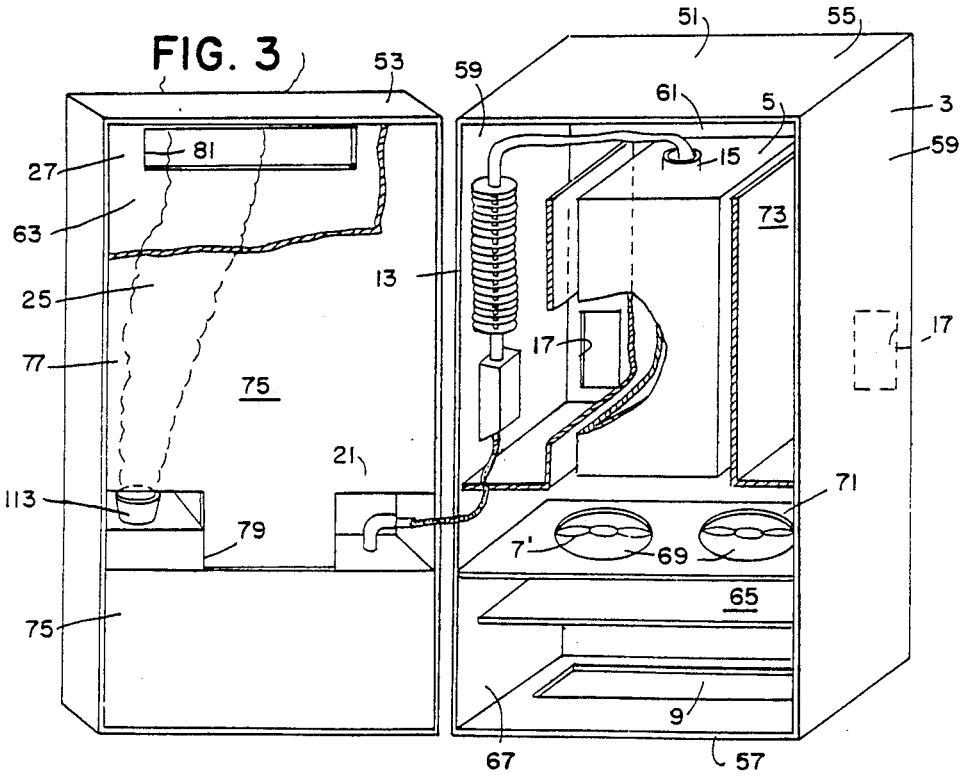

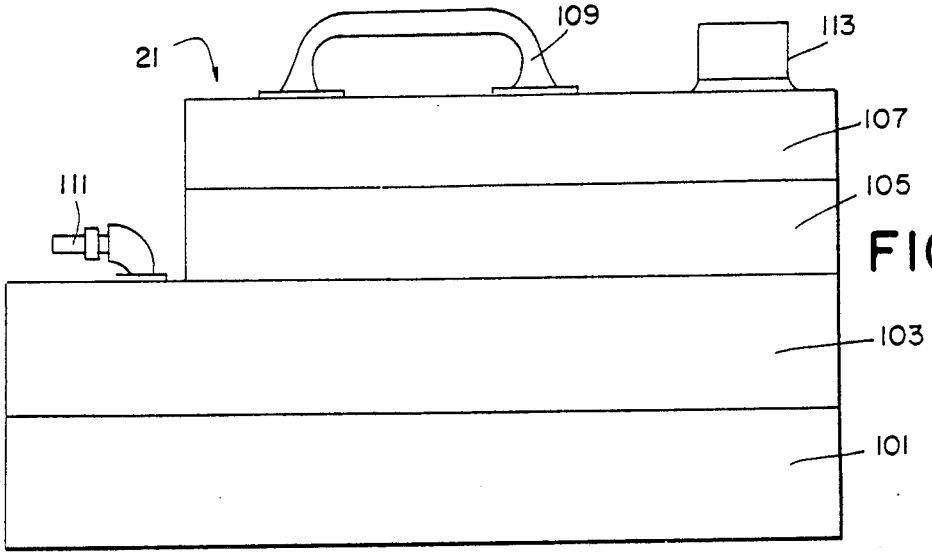
FIG. 12
FIG. 13
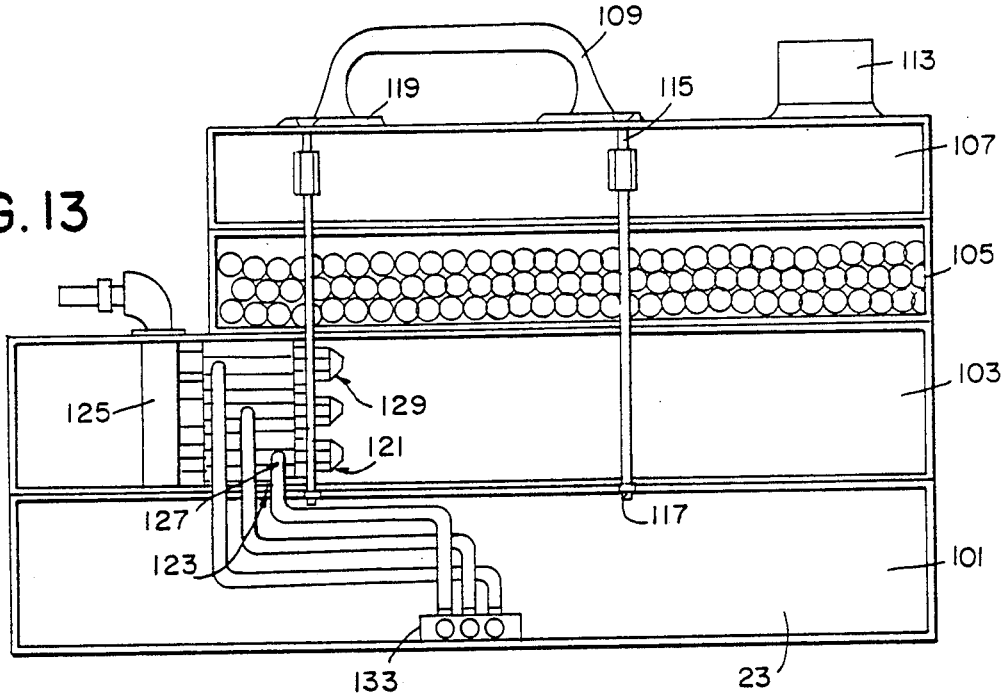
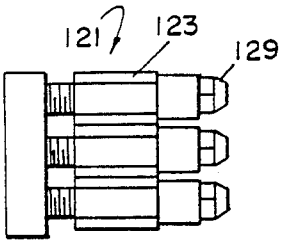
FIG. 14
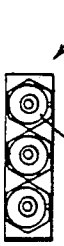
FIG. 15

DIFFUSION FOGGER

This application is a continuation of application Ser. No. 348,775, filed May 8, 1989.

BACKGROUND OF THE INVENTION

This invention concerns improvements in diffusion foggers used in photographic, motion picture, video production, and entertainment industries.

Smoke effect in the film industry can be broken down into two main categories: (1) SMOKE and (2) FOG or "atmosphere". SMOKE is generally a very thick, milky cloud of true smoke: the result of a volatile oil or other fuel being heated to just below its flash point. A list of SMOKE making equipment would include Igebas TM, Mole Guns TM, and Roscoes TM, all of which involve some form of heating element. FOG, or "atmosphere", is a more common albeit somewhat less dramatic effect, helping to soften images, enhance light beams, and give the impression of dust or moisture, among other things. In the early days of cinema, smoke making equipment was used to create indoor fog effects. It was all they had, and one could achieve a nice effect simply by thoroughly mixing the smoke with the air, thinning it into a haze. The one problem, aside from the danger of fire, was the tendency for crew members to fall over dead from breathing the smoke. Mixed with a bit of poison, the smoke from these devices made a terrific insecticide, which was its original function before the turn of the century.

In 1955, the oil cracker barrel was designed to create a fog effect without combustion in the following way. Compressed air is shot into a bath of oil from submerged nozzles, bubbling violently up through the barrel and sending a steady, thick cloud of oil particles, looking very much like a cloud of water vapor, into the air. Large, heavy particles fall quickly out of the cloud, while smaller particles stay aloft for up to several hours. Oil particles smaller than a certain critical diameter remain in the air essentially forever, buoyed by the brownian motion of air molecules.

With a cracker barrel, all sizes of droplets are produced and sent into the air, only a small fraction of which are small enough to hang in the air for more than an hour. The rest of the oil falls out and forms a residue on food, expensive camera equipment, and in the lungs of nearby crew members. The "smoke", though relatively safe to breathe, is uncomfortable in the lungs. It burns the throat and can cause nausea and dizziness after only a few hours of moderate exposure Yet the cracker barrel has remained a very popular smoke machine for almost 30 years because it is cheap and simple to run, can create a range of effects from subtle haze to thick fog, and although it does cause discomfort it is a definite health improvement over heating element-based smoke systems.

In 1986, Reel Efx Inc. introduced the Diffusion Fogger to the marketplace. The Diffusion Fogger, now known as the Senior Diffusion Fogger, was a vast improvement over the cracker barrel, primarily because of the size of oil particles produced. The Senior Diffusion Fogger sends only the smallest particles, those at or below the critical diameter mentioned above, into the air, and lots of them, producing an almost identical effect for longer periods without residue or discomfort to the film crew.

The Food and Drug Administration designation CFR 21.878 defines the purity of the food grade oil used by the Diffusion Fogger. Specifically, it does not allow the presence of polycyclic aromatic hydrocarbons (PAH) or trace heavy metals, both of which may be found in mineral oil used industrially or in systems employed by the special effects industry. PAH's are known to be carcinogenic at very low levels, and the toxicological effects of heavy metals are well established medically in a variety of pathologies.

The Senior Diffusion Fogger produces "smoke" using compressed air and a highly purified version of the oil found in a cracker barrel, but there the similarities stop. Instead of simply bubbling the air up through the oil, the Diffusion Fogger atomizes it in rather the same way that modern snowmaking equipment atomizes water. A special nozzle draws oil to its intake and mixes it with high pressure air, firing a very fine mist of oil and air directly into a filtration chamber. The chamber is filled with small nylon balls, around which the suspended oil particles are forced to travel for several inches. Larger, more massive particles, which cannot negotiate the sharp turns within the chamber, strike these obstacles, form droplets, and trickle back down into the oil tank to be recycled. As a final step, the smoke is then sent through a fibrous material which smoothes the flow and filters out any large particles which managed to make it through the grueling course laid out by the packed nylon balls.

An analogous situation occurs within the human lung. As it is inhaled, air is forced to turn sharply and flow through tight passages, while cilia along the walls of bronchial tubes catch any foreign particles that lumber into them. By definition, the Diffusion Fogger's unique filtration system releases into the air only those particles which can evade cilia indefinitely, going out as easily as they went in and saving the lungs a lot of aggravation. Indeed, despite the higher cost, the Diffusion Fogger became popular during the first two years of its availability. Despite the popularity, problems remained in that size and weight and power requirements added a burden to shipment, installation and use.

SUMMARY OF THE INVENTION

The present invention was designed to produce a small version which would be easier to build and transport. In the end, the resulting design was an improvement over the originals. The present Junior Diffusion Fogger is an improvement over all existing technology.

| | Senior Diffusion Fogger | Junior Diffusion Foqger |
|---|---|---|
| 1. Weight | 650 lbs. | 150 lbs. |
| 2. Size | 51" × 40" × 30" (35 cu. ft.) | 45" × 23" × 17" (10 cu. ft.) |
| 3. Noise | 92 db | 59 db |
| 4. Power | 3 Phase, 17 amps/leg | 110 v AC, 15 amps |
| 5. Fog Temp. | 90° F. | 65° F. |
| 6. Output | 100% | 75% |

The new fogger is lighter in weight. Most of the weight in either fog machine is concentrated in the air compressor. The Junior Fogger has a much smaller compressor and therefore requires lighter components and supports, reducing the total weight more than fourfold. Less mass translates into cheaper, faster construction, and of course far more convenient transportation.

The new fogger is smaller. The smaller size of the present invention was made possible by a more efficient design. After some weeks of testing, the inventor discovered that the air pressure required for optimum fog output through atomizing nozzles was less than had been expected: about 35 psi. A small air compressor with a more efficient pressure/flow ratio was already available off the shelf, and was incorporated into the design. The invention also provides a one-piece, portable "fog head": an oil tank, atomizer and smoke filter all in one. The entire package, including thick sound suppressing foam and components which remove heat and moisture from the high pressure air, fits inside a standard size road case.

On set its small size and low weight make the Junior Fogger the most convenient non-heating element-based fog machine to use, bar none. The road case has three handles and is mounted on wheels, making it easy to roll around a cramped room and even to carry up stairs. The case is finished in unobtrusive grey carpeting and has a flat linoleum top for the setting of tools, drinks, and the not-so-occasional elbow.

The new fogger is quieter. Every bit as important to a film crew as a fog machine's size is the amount of noise it produces and the frequency of that noise. Simply, the Junior Diffusion Fogger is the quietest fog machine on the market. The air compressor chosen for the design is fairly quiet to begin with. Its noise is located primarily at high frequencies and very low frequencies. Most of it is eliminated with the use of special sound-absorbing foam liners. After testing various arrangements, the inventor produced a prototype fogger which emitted only about 60 decibels of Type A noise, compared with over 90 decibels for the Senior Fogger.

The new fogger takes less power to operate. The new Junior Fogger not only takes less power to run than a Senior Fogger, the Junior Fogger takes a much more convenient kind of power: namely, regular house current as opposed to 3 Phase. This improvement means the Junior Fogger can be used on location as easily as it is used on stage, and the amperage drain on lighting and other equipment being used on the same line is greatly reduced.

The fog temperature is cooler: The "smoke" produced by a Junior Fogger is cooler than that of a Senior Fogger which makes it more controllable. The fog is cooler because unlike the original system, the Junior is designed to remove heat from the compressed air, which has been heated considerably during the compression process, and exhaust that heat separately, using ambient air in producing fog which under normal conditions is at or slightly below ambient temperature. Fog is more controllable at this temperature because it mixes perfectly with the air. Warm fog or smoke tends to rise and fill a stage from the ceiling on down which delays shots, the majority of filming being done at eye level.

On the other extreme, a cracker barrel often produces fog that is so cold it refuses to rise more than a few meters above the stage floor without help from a fan. The fog is cold because the compressed air used in a cracker barrel is stored in a tank until it is needed. This air generally has plenty of time to cool to room temperature before it is decompressed, cooling well below that temperature when blown into the oil. The Junior Fogger's smoke, energetically more compatible with the outside air, mixes more quickly and evenly than either the cracker barrel or the Senior Fogger.

The new fogger has substantial fog output. The new Junior Diffusion Fogger, despite its smaller size, lower weight and reduced power consumption, still manages to produce 75 to 80 percent of the smoke generated by the Senior Fogger with equal hang time, which is up to ten times that of a standard oil cracker barrel.

The present Junior Diffusion Fogger's design is a vast improvement over all known artificial smoke and fog production technology which exists at the present time.

The diffusion fogger of the present invention is packed in a road case. Fans mounted on a fan shelf draw air from an opening in the bottom of the case, through a baffle chamber and through fan openings into a fan chamber, an air compressor above the fan chamber provides compressed air to a fog head assembly. The fog head assembly releases an oil mist fog into a mist duct and air from the fan chamber is blown through the duct and out through a front opening in entraining the mist and delivering the mist to the desired location. Air from the fan chamber circulates over the compressor, cooling the compressor, and passes around a heat exchanger on a compressed air line within an air outlet duct, cooling the compressed air. The fog head, which is removable, is a vertical assembly of chambers The lowest chamber is an oil sump. The second chamber is a nozzle array chamber. Vertically aligned nozzles have inlets connected to an air manifold. The nozzles draw up filtered oil from an oil manifold through oil tubes and spray a fine mist of oil and decompressed air into the nozzle chamber. The airborne mist continues through the next above chamber, a baffle box filled with marbles, depositing large oil droplets as the mist turns through the marble bed. Oil collected by the marbles drains through the nozzle chamber into the sump, and the mist continues upward and horizontally through a foam filter in the top chamber. The mist is exhausted through a vertical tube into the mist duct, where it is entrained in the air stream delivered by the fans which carries the mist to the desired location. The fog head and mist duct are located in a vertically hinged door on the road case.

A preferred diffusion fogger of the invention includes a soundproof case, an air compressor having an inlet and outlet mounted within the case, and a heat exchanger connected to the outlet of the air compressor for cooling compressed air. A water trap is connected to an outlet of the heat exchanger for removing water from the cooled compressed air. A venturi nozzle releases the compressed dry air. An oil tube supply connected to the nozzle draws oil from an oil supply into the nozzle, and atomizes the oil with the compressed air, and releases atomized oil from the nozzle. A fan mounted in the case draws air into the case and flows air over the air compressor for cooling the air compressor, and directs air over a heat exchanger for cooling compressed air. Hot air from the heat exchanger flows directly out of the case. Separate ducts direct air from the fan around the atomized oil and decompressed air from the nozzle and out of the case, entraining the fog.

Preferably the case is insulated and has one inlet for drawing in air and a baffle around which air passes. Parallel fans mounted in apertures draw air in through the inlet and around the baffle. First and second hot air outlets exhaust air heated by the air compressor and the heat exchanger. A horizontally elongated outlet releases ambient-temperature air entraining the oil fog.

Preferably the single air inlet is located in the bottom of the case. The preferred baffle is a shelf extending partially across the bottom of the box above the inlet. The fans are mounted in parallel openings in a shelf above the baffle shelf. The compressor is mounted directly above the fans. Warm air ducts are positioned laterally adjacent the compressor. The nozzle is mounted in a nozzle assembly positioned opposite the baffle.

Preferably the nozzle assembly is separated from the baffle by a vertically positioned insulated sound cover.

The preferred case is a generally rectangular insulated container having a relatively large back wall, opposite side walls and top and bottom walls, an elongated air inlet opens in the bottom wall near the back wall, a horizontal baffle shelf extends between the side walls along the back wall above the inlet opening. A horizontal fan opening shelf is positioned above the horizontal baffle wall, and first and second fans positioned in first and second openings for drawing air from the inlet opening around the baffle wall and through the fan openings. A sound suppressing cover is fitted between the fan opening shelf and the bottom for completing a baffle box, with an elongated opening between a front edge of the baffle wall and the sound insulating cover. First and second exhaust ducts mounted inside opposite sides and extend forward from the back wall. First and second exhaust openings at middle portions of the back wall communicate with the exhaust ducts. The exhaust ducts inlet openings are at positions spaced downward from the top. A compressor is positioned in the container between the exhaust ducts and is spaced above the fans and below the top for flowing air over the compressor and out through the exhaust ducts. Air intakes in the compressor are near the fans. A compressed air exhaust is at the top of the compressor, and a heat exchanger connected to the compressed air exhaust at the top of the compressor cools the heat exchanger and compressed air in the heat exchanger with air flowing toward the exhaust duct. A partition cover vertically positioned in the box between the side walls and spaced from the front wall forms with the front wall and portions of the side walls a mist delivery duct. The partition has openings for delivering air from the fans for mixing the fan-driven air with oil mist and decompressed air. The front wall has an elongated horizontally-extending opening near the top for flowing fan-driven air, oil mist and compressed air out of the opening as a diffusion fog.

In the preferred embodiment, the container is constructed as a road case. Caster wheels are connected to the bottom wall, and handles re connected to the side walls and the top.

Preferably the top and bottom and side walls are divided, and the divided portions of one side wall are hinged together. The container is formed with a relatively deep laterally-opening box and a relatively shallow laterally-opening box. The air inlet, the baffle shelf and the fan supporting shelf, the exhaust ducts and the compressor are mounted in the relatively deep box, and the nozzle assembly and the mist duct are positioned in the relatively shallow box.

Preferably the container is entirely lined with ¼ inch foam. The side, top, bottom, rear and front walls are joined together by angular aluminum strips. The top and bottom walls, baffle shelf and fan shelf and exhaust duct are lined further with 1 inch foam. Additional layers of ½ inch and ¼ inch foam are interposed between the ¼ inch and 1 inch foam on the top wall.

In the preferred fogger apparatus the nozzle assembly includes a multiple layer, thin, rectangular nozzle head and filter box. An oil sump and oil intake manifold at the bottom of the chamber, the oil intake manifold has three vertically-oriented oil line connectors and horizontally-extending oil filters. A site glass is connected to a side of the oil sump chamber. Oil tubes are connected to the oil manifold and extending upward through an opening in the top of the oil sump chamber. A nozzle chamber has an opening in a bottom aligned with the opening in the top of the oil sump chamber. An air manifold is positioned in the nozzle chamber. A plurality of nozzles have inlets connected to the air manifold and have spray nozzle outlets. Oil inlets on the nozzles between the air inlets and the spray nozzles connect the oil lines for drawing oil through the filters and oil manifold and oil lines into the nozzles, with air flowing through the nozzles from the air manifold. A compressed air quick-coupling connector is connected to the air manifold. A nozzle access hole is positioned in the nozzle chamber cover. A mist flow hole in the cover remote from the nozzle access hole flows mist upward. A marble maze chamber is positioned above the nozzle chamber. The marble maze has side walls and a bottom wall with a plurality of openings above the mist opening in the nozzle chamber for flowing mist through the plurality of openings. Marbles are disposed in the marble chamber. A cover on the marble chamber has a mist-releasing opening at an end of the chamber opposite the plural mist-flowing openings in the bottom of the marble chamber. A filter chamber is positioned above the marble chamber. A mist duct is connected to the opening in the top wall of the filter chamber.

Bolts extend downward through the filter chamber, the marble chamber, the nozzle chamber and the cover of the oil sump chamber and hold the chambers vertically assembled together.

A handle is connected to the bolts on top of the cover of the filter chamber for lifting and carrying the mist head assembly.

In a preferred embodiment, a power cord having a 110 volt AC plug is connected to the road case. A switch, a timer and a remote controlled switch are connected to the power cord for turning on the air compressor and fans when the switch is turned on for creating and delivering fog by providing compressed air to the venturi nozzle array, drawing oil from the sump with the compressed air flowing through the nozzles, spraying the oil in a fine mist with the nozzles and decompressed air, turning and filtering the mist and mixing the mist with air currents from the fans and carrying the mist with the fan-blown air currents.

These and other and further objects and features of the invention are apparent in the disclosure, which includes the above and ongoing specification, with the claims, and the drawings.

BRIEF DESCRIPTION OF THE DRAWINGS

FIG. 1 is a schematic view of the parts and operation of the invention.

FIG. 2 is a schematic view of the electrical operations.

FIG. 3 is a schematic view of parts of the diffusion fogger of the present invention showing covers repositioned on the door section.

FIG. 12 is an elevation of the fogger head of the present invention.

FIG. 13 is a schematic representation of the fogger head shown in FIG. 12.

FIG. 14 is an elevation of the nozzle assembly.

FIG. 15 is an elevation of the nozzle assembly.

DETAILED DESCRIPTION OF THE DRAWINGS

Figure 4:
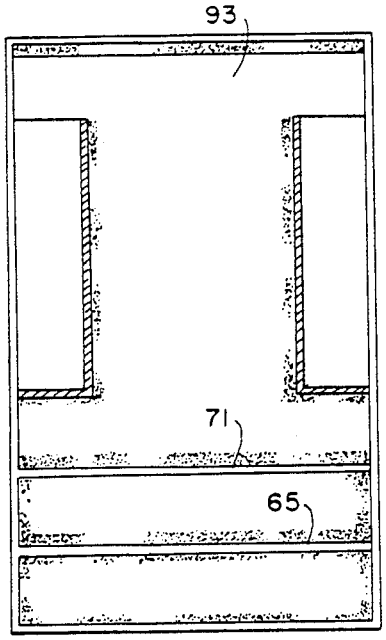
FIG. 4 is a rear elevation showing the inside of the diffusion fogger with the rear wall removed.

Referring to FIG. 1, the diffusion fogger is generally indicated by the numeral 1. An insulated case 3 holds an air compressor 5. Fans 7 draw air through inlet 9 and flow the air around the air compressor and around a heat exchanger 13 connected to an outlet 15 of the air compressor. After passing over the air compressor and over the heat exchanger, the air passes out exhaust port 17. The compressed air continues through a water trap 19 and then into a nozzle 21, which draws oil from a sump 23 and sprays a fine oil mist 25 which is entrained by air from fan 7 and flowed through the mist port 27. The cooling of the air compressor and the heat exchanger with separate ambient air ensures the mist temperature is about 50° F., which tends to stabilize the mist as earlier described.

The electrical system 31 shown in FIG. 2 has a plug 33 for ordinary house current. A switch 35 on the unit starts the operation of air compressor 5 and fans 7 and 7' to create diffusion fog. A remote switch 37 turns on and off with a signal received by an antenna 39. A remote manual button 41 controls the electric circuit 31, supplying power to the air compressor 5 and fans 7 and 7'. A neon light 43 indicates that the system is operating, and a run time clock 45 may be set to control the run time and automatically turn the power 31 off after a predetermined time.

Parts of the assembled apparatus are schematically shown in FIG. 3.

Case 3 is constructed as a road case or trunk with a main box part 51 and a box-like cover 53. The case has a top 55 and a bottom 57 and opposite side walls 59. The case also has a rear wall 61 and a front wall 63.

As schematically shown in FIG. 3, the inlet port 9 is positioned in the bottom wall 57 near the rear wall 61. A horizontal baffle wall 65 is spaced above the opening 9 so that air in baffle chamber 67 flows around the baffle wall. The baffle 65 prevents fan and compressor noise from escaping the sound insulated case 3.

Fans 7 and 7' are mounted in opening 69 in the fan shelf 71.

As schematically shown by the arrows representing the air currents, the fans blow air upward over compressor 5 and over heat exchanger 13. The air flow laterally outward beneath top 55, and downward through exhaust ducts 73, and then outward from the paired exhaust ports 17.

Ports 17 are located medially and near lateral edges of rear wall 61, pushing heated air rearwardly from the case. The heated air tends to rise, avoiding the recycling of the heated air through the ambient air intake 9.

In the schematic representation of FIG. 3, the heat exchanger 13 is schematically shown in one exhaust duct, and the exhaust ducts 73 are shown extending to the open front of the large box portion 51. In a preferred construction, the ducts are spaced inward from the opening and are closed by separate front walls of the ducts.

For convenience, the heat exchanger 13 is shown positioned in one warm air exhaust duct. In a preferred embodiment, the heat exchanger is positioned above the compressor.

As shown in FIG. 3, a sound insulated cover 75 separates the fogger head 21 from the intake baffle chamber 67. An upper partition cover 77 separates the compressor compartment from the upper portion of the box-like case cover 53. The partition 77 has openings 79 which permit air to flow into the cover and into a fog duct 81 between the front wall and the partition 77. Air flowing from the fan chamber through the openings 79 entrains and mixes with the fog 25 from the fog head 21, and carries the fog out through fog port 27. The fog port 27 extends horizontally along an upper portion of the front wall 63 so that the fog projects horizontally. Since the fog is at or slightly below ambient temperature, the fog tends to remain in the general eye-level range. Fog port 27 is placed at the location on the case which is most remote from the air intake 9 to prevent recycling of the fog into the case.

While cover 75 and partition 77 are shown positioned on the shallow box-like cover portion 53, in preferred embodiments the cover 75 and partition 77 are mounted at the face of the large box-like portion 51. The result is substantially the same in either case.

FIG. 4 is a rear elevation of the box from which the rear wall has been removed.

The baffle 65 and baffle compartment 67 are shown lined with sound deadening ¼ inch and ½ inch foam insulation. Fan mounting shelf 71 has sound deadening insulation on both sides.

Figure 5:
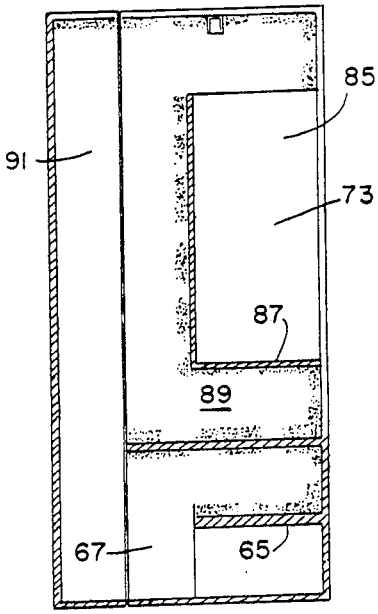
FIG. 5 is a side view of the diffusion fogger with one side wall removed.
Figure 6:
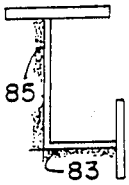
FIG. 6 is a detail of the exhaust duct.

As shown in FIG. 5, baffle 65 is positioned to shield the intake opening on the bottom wall from the fan openings. The exhaust ducts 73 have front walls 83, side walls 85, and bottom walls 87. From fan chamber 89, air flows upward through the compressor chamber 91, outward along the heat exchanger chamber 93, and downward into the exhaust ducts 73.

Figure 7:
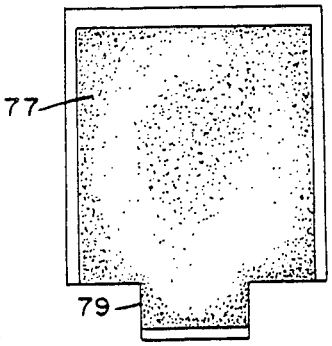
FIG. 7 is an elevation of a sound-suppressing partition cover which separates the mist duct from the compressor chamber.
Figure 8:
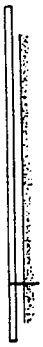
FIG. 8 is a side elevation of the partition shown in FIG. 7.

FIGS. 7 and 8 show the partition cover 77 with the air flow openings 79. As shown in FIG. 8, the compressor side of the partition 77 is lined with ¼, ½, ¼ and 1 inch foam. The fog duct side is plain.

Figure 9:
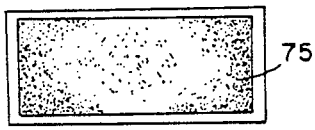
FIG. 9 is an elevation of a cover which separates the inlet baffle chamber from the fogger head chamber.
Figure 10:
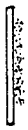
FIG. 10 is an end elevation of the cover shown in FIG. 9.

FIGS. 9 and 10 are details of the baffle chamber cover 75, which is lined with ¼ and 1 inch foam. The cut-out edge portions of the foam accommodate foam from the abutting walls.

Figure 11:
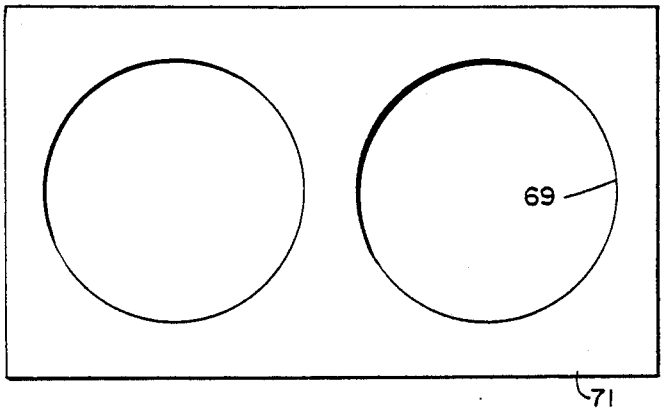
FIG. 11 is a plan view of the fan mounting shelf.
Figure 16:
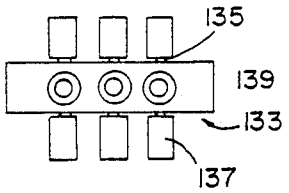
FIG. 16 is a plan view of the oil manifold.
Figure 17:
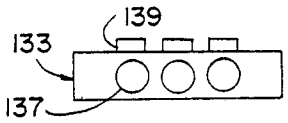
FIG. 17 is an elevation of the oil manifold shown in FIG. 16.
Figure 18:
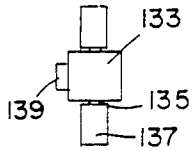
FIG. 18 is an end view of the manifold shown in FIGS. 16 and 17.
Figure 19:
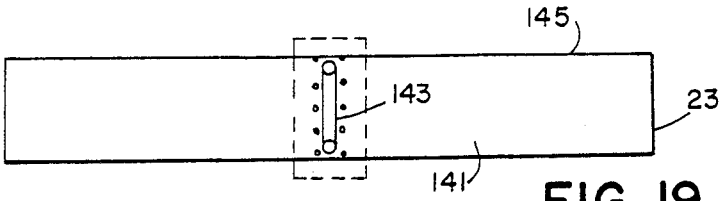
FIG. 19 is a side view of the oil sump chamber showing the site glass mounting.
Figure 20:
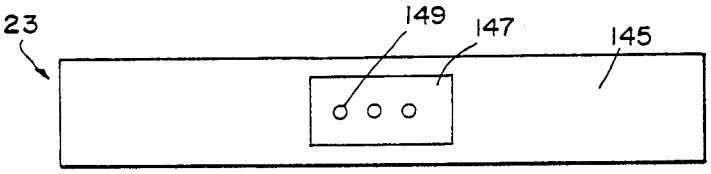
FIG. 20 is a plan view of the sump cover.

FIG. 11 is a detail of the fan plate or shelf 71, with openings 69 for mounting the fans.

The fog head 21 is shown in FIGS. 12–26. The fog head assembly has four chambers, 101, 103, 105 and 107. A handle 109 is mounted on the top chamber A quick-connect air hose coupling 111 is mounted on the second chamber 103, and a mist exhaust conduit 113 is mounted on the top chamber 107. Bolts 115 with cap nuts 117 extend through handle flanges 119 and through chambers 107, 105 and 103 and the cover of chamber 101, and hold the fog head assembly 21 together.

Referring to FIGS. 13, 14 and 15, chamber 103 contains the fog nozzle array 121. Three identical vertically aligned nozzles 123 have inlets 125, suction ports 127, and spray nozzles 129. The inlets 125 are connected to compressed air manifold 131, which is connected through the cover of nozzle chamber 103 to the quick-connect coupling 111.

Referring to FIGS. 13 and 16–20, lower chamber 101 is an oil sump 23. Oil intake manifold 133 is positioned on the base of the oil sump 23. In a preferred embodiment, the oil intake manifold has six inlet ports 135 supplied with filters 137 and three outlet ports 139.

One of the side walls 141 of the lower chamber 101 is fitted with a site glass 143, which shows oil level within the sump 23. The cover 145 of the lower chamber has a central, generally rectangular opening 147 to provide passage for the oil suction tubes 149.

In a preferred embodiment of the invention, the fog head 21 is made of four aluminum box tubing sections which are capped to size and then milled. Walls are ⅛ inch thick. Holes 151 in the cover 145 of the lower chamber 101 may be tapped or may be recessed to receive fixed nuts 117 used to secure bolts 115.

Figure 21:
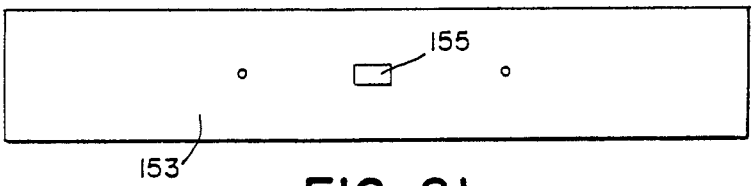
FIG. 21 is a plan view of the fog head nozzle chamber base.
Figure 22:
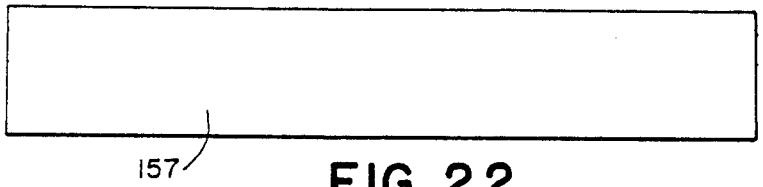
FIG. 22 is an elevation of the fog head side wall.
Figure 23:
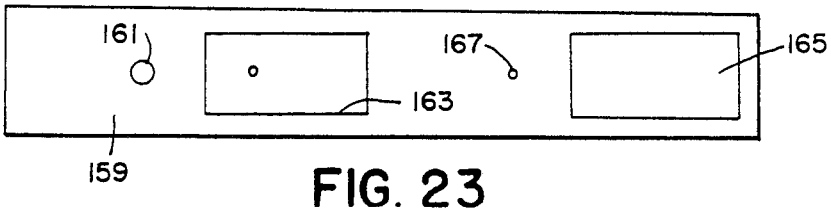
FIG. 23 is a plan view of the nozzle chamber cover.

FIGS. 21, 22 and 23 show details of the bottom, side and top walls of the nozzle assembly chamber 103. The bottom wall 153 has a small rectangular central opening 155 for passing the oil suction tubes 149. The side walls 157 are substantially plain. The top wall 159 has a small hole 161 for connecting the quick-connect coupling 111 with the air manifold 131. A larger rectangular hole 163 is provided for access to tee nozzle assembly 121. An oil mist exit hole 165 supplies oil to the next above marble filter chamber. Holes 167 receive the mounting bolts 115.

Figure 24:
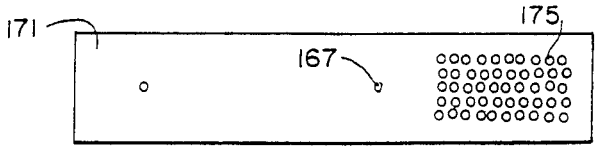
FIG. 24 is a plan view of the marble chamber base.
Figure 25:
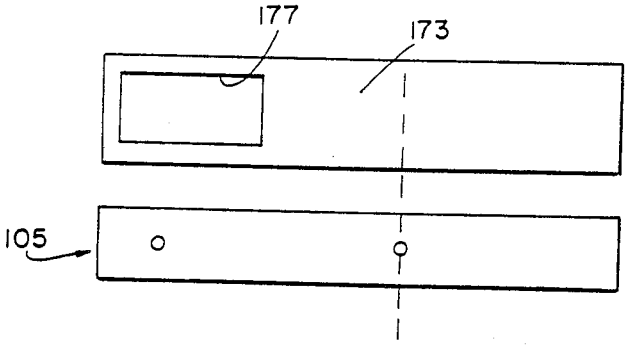
FIG. 25 is a plan view of the marble chamber cover.
Figure 26:
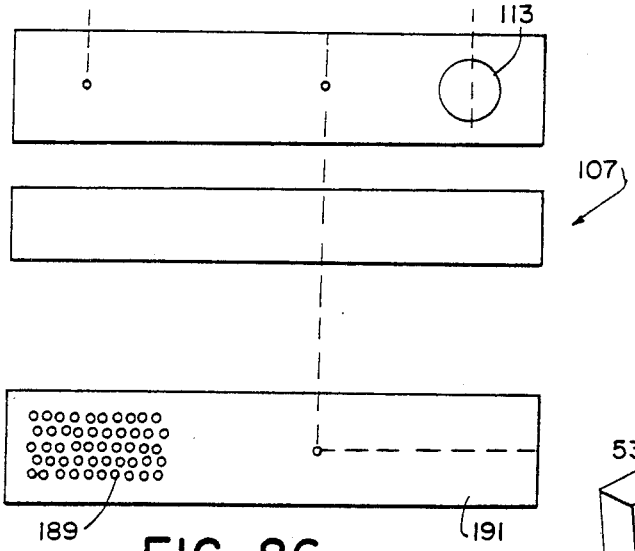
FIG. 26 is a plan view of the filter chamber base.
Figure 27:
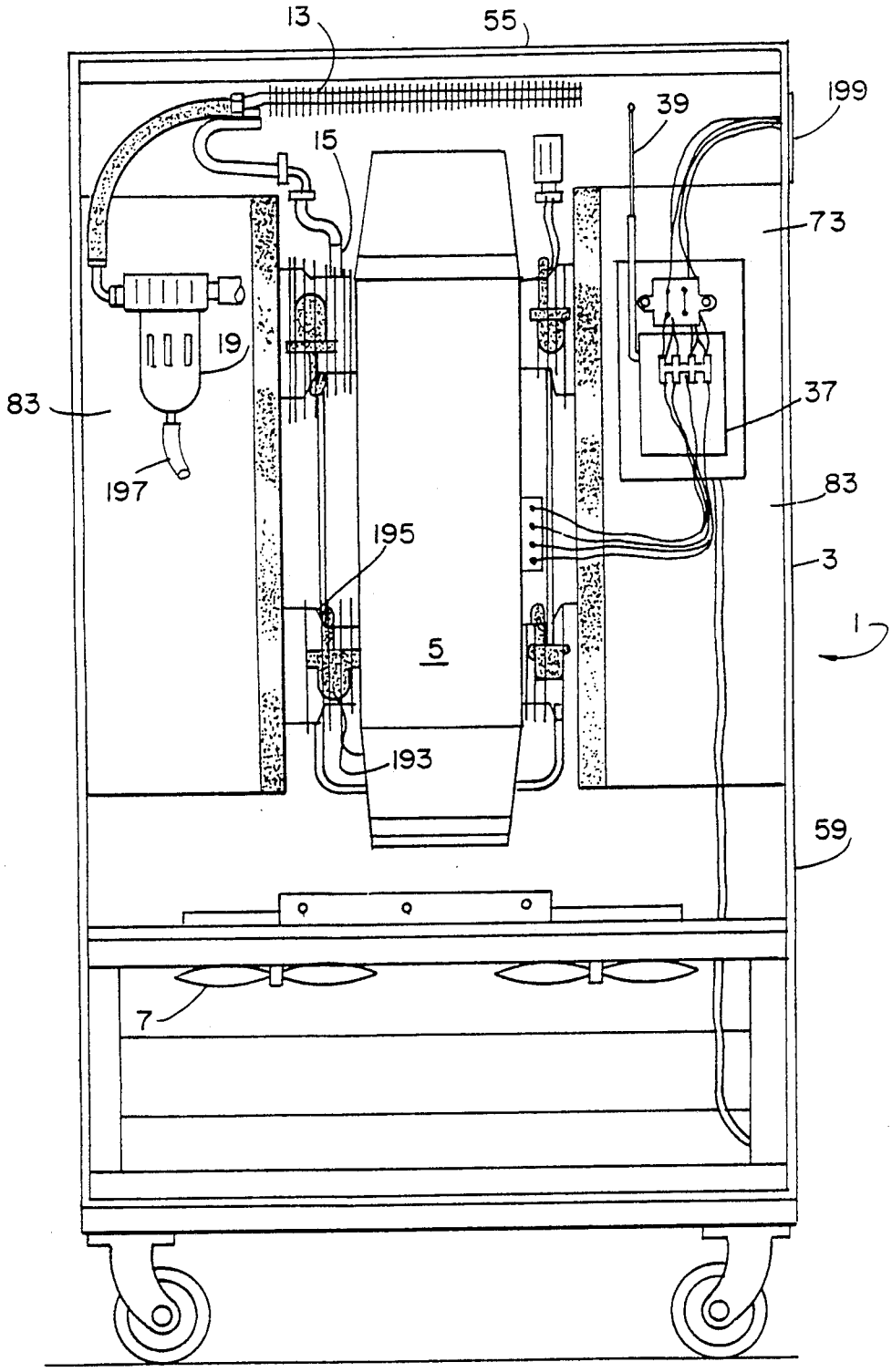
FIG. 27 is a front elevation of the components in the main box of the case.
Figure 27A:
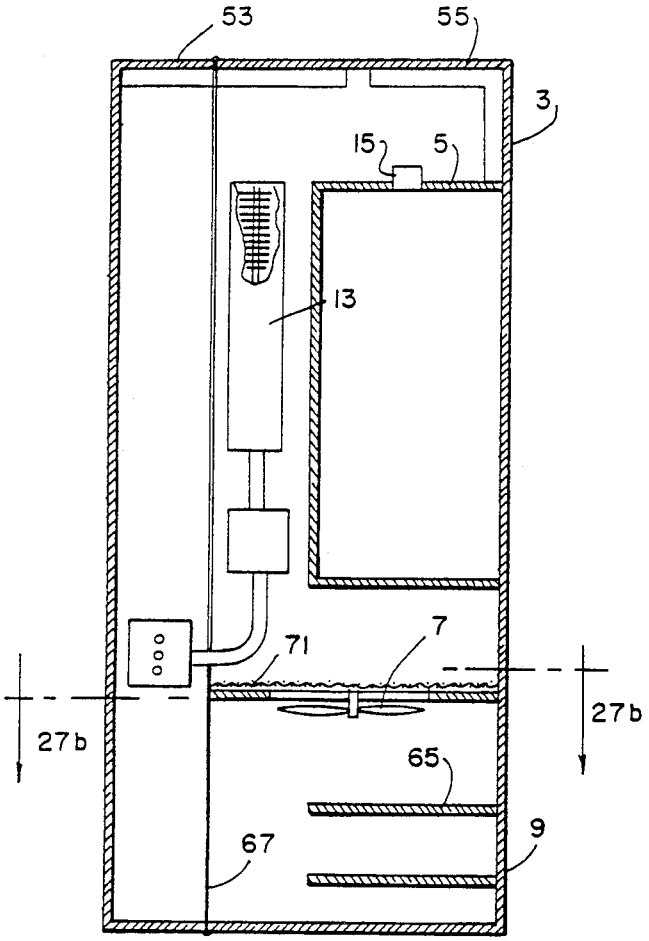
FIGS. 27*a* and 27*b* are cross sectional views through the FIG. 27 system.
Figure 27B:
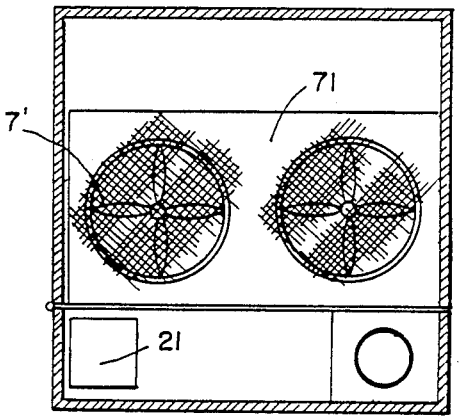

Details of the bottom 171 and top 173 of the first filter chamber 105 are shown in FIGS. 24 and 25. The bottom has bolt-receiving holes 167 and an array of small 1/4 inch holes 175, which are aligned with the mist flow opening 165 in the nozzle assembly chamber 103. The mist produced in the nozzle chamber flows upwardly through hole 165 and small holes 175, which retain the mist-twisting marbles in chamber 105. Turning the mist through the passageways between marbles removes large droplets from the mist. The mist then flows outward through hole 177 in the top 173 of the marble chamber. The mist flows through openings 189 in the bottom 191 of chamber 107, which contains a foam filter, and the fine mist flows outward from port 113. The oil mist flowing from port 113, which includes fine oil particles uniformly dispersed in the air expanded in the venturi nozzles 121, is entrained by the fan-driven air stream flowing through opening 79 in the partition 77, moving a fine oil particle fog outward through fog port 27 in the front wall of the case 3. [Check this last sentence] As shown in FIG. 27, the air compressor 5 has air intakes 193 which supply air-cooled cylinder heads 195. Compressed air moves from compressor outlet 15 through heat exchanger 13 mounted inside of the top wall 55. Air from fans 7 flows over the compressor 5, into the air intakes 193, over the air-cooled cylinders 195 and over heat exchanger 13, before flowing into the exhaust ducts 73. Water trap 19 is mounted in the cool airstream on the outside of exhaust duct wall 83. A water drain tube 197 passes rearward into the duct and out through the rear exhaust port 17 which is associated with that duct 73. A remote control switch 37 with an antenna 39 is mounted on the front wall 83 of one exhaust duct 73.

The bypass switch 35, neon light 43, and run timer clock 45 are mounted in panel 199 on the upper part of one wall 59.

Figure 28:
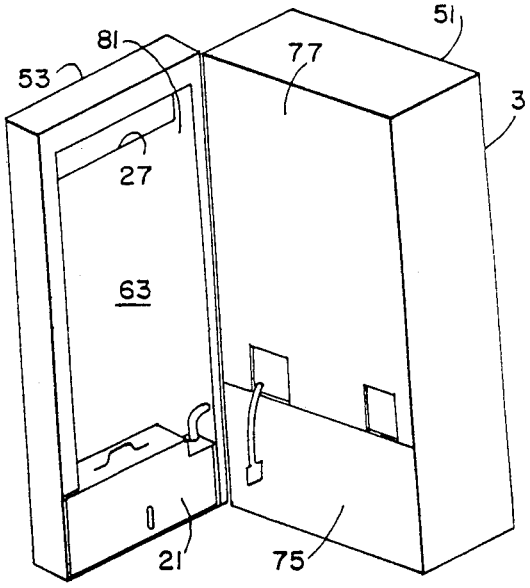
FIG. 28 is a schematic detail of the arrangements of the covers and the fog head.

As shown in the schematic representation in FIG. 28, the partition cover 77 and the baffle chamber cover 75 are placed over the large box-like section 51 of the case 3. The fog head 21 is positioned within the open lower end of the shallow box-like portion 53, and the fog duct 81 is formed in the void space above the fog head 21, between the front wall 63 and the partition 77.

While the invention has been described with reference to specific embodiments, modifications and variations of the invention may be constructed without departing from the scope of the invention, which is described in the following claims.

I claim:

1. A diffusing fogger, comprising a soundproof case, an air compressor having an inlet and outlet mounted within the case, a heat exchanger connected to the outlet of the air compressor for cooling compressed air, a water trap connected to an outlet of the heat exchanger for removing water from the cooled compressed air, a venturi nozzle connected to the water trap for releasing dry compressed air, an oil supply connected to the nozzle for drawing oil from the oil supply into the nozzle and atomizing the oil with the dry compressed air and releasing atomized oil from the nozzle, a fan mounted in the case for drawing air into the case and drawing air over the air compressor for cooling the air compressor, and air-directing ducts for directing air from the fan over the compressor and the heat exchanger and directing hot air from the heat exchanger out of the case, and further air-directing ducts for directing air from the fan out of the case around the atomized oil and air from the nozzle.

2. The apparatus of claim 1, wherein the case is an insulated case having one inlet for drawing in air and a baffle around which air passes, parallel fans mounted in apertures for drawing air in through the inlet and around the baffle, and first and second hot air outlets for releasing air heated by the air compressor and the heat exchanger, and a horizontally elongated outlet for releasing ambient air and oil fog.

3. The apparatus of claim 2, wherein the single air inlet is located in the bottom of a box, wherein the baffle comprises a shelf extending partially across the bottom of the box above the inlet, wherein the fans are mounted in parallel openings in a shelf above the baffle shelf, wherein the compressor is mounted directly above the fans, wherein the warm air ducts are positioned laterally adjacent the compressor, and wherein the nozzle is mounted in a nozzle assembly positioned opposite the baffle.

4. The diffusion fogger of claim 3, wherein the nozzle assembly is separated from the baffle by a vertically positioned insulated cover.

5. The diffusion fogger apparatus of claim 1, wherein the case comprises a generally rectangular insulated container having a relatively large back wall, opposite side walls and top and bottom walls, an elongated air inlet opening in the bottom wall near the back wall, a horizontal baffle shelf extending between the side walls along the back wall above the inlet opening, and a horizontal fan opening shelf positioned above the horizontal baffle wall, and first and second fans positioned in first and second openings in the fan shelf for drawing air from the inlet opening around the baffle wall and through the fan openings a sound suppressing cover fitted between the fan opening shell and the bottom for completing a baffle box with an elongated opening between a front edge of the baffle wall and the sound insulating cover, first and second exhaust ducts mounted inside opposite sides and extending forward from the back wall, and first and second exhaust openings in the back wall communicating with the exhaust ducts, the exhaust ducts leaving entrance openings at positions spaced downward from the top, the compressor positioned in the container between the exhaust ducts and spaced above the fans and below the top for flowing air over the compressor and out through the exhaust ducts, an air intake in the compressor near the fans and a compressed air exhaust on the compressor, the heat exchanger connected to the compressed air exhaust and positioned in an air stream between the fans and the exhaust openings for cooling the heat exchanger and compressed air in the heat exchanger with air in the exhaust duct, a nozzle assembly positioned in the container opposite the sound-insulating cover and a conduit connecting the heat exchanger with the nozzle assembly, the nozzle assembly having an outlet for delivering oil mist and decompressed air, a partition cover vertically positioned in the box between the side walls and spaced from the front wall for forming with the front wall and portions of the side walls a fog delivery duct, the partition having openings for receiving air from the fans for mixing the fan-driven air with oil mist and decompressed air, and the front wall having an elongated horizontally-extending opening near the top for flowing fan-driven air, oil mist and compressed air out of the opening as a diffusion fog.

6. The apparatus of claim 5, wherein the container is constructed as a road case, with caster wheels connected to a bottom wall and handles connected to side walls.

7. The apparatus of claim 5, wherein the top and bottom and side walls are divided and wherein the divided portions of one side wall are hinged together, whereby the container is formed with a relatively deep laterally-opening box and a relatively shallow laterally-opening box, wherein the air inlet, the baffle shelf and the fan supporting shelf, the exhaust ducts and the compressor are mounted in the relatively deep box, and wherein the nozzle assembly and the fog duct are positioned in the relatively shallow box.

8. The apparatus of claim 5, wherein the container is entirely lined with $\frac{1}{4}$ inch foam, wherein the side, top, bottom, rear and front walls are joined together by angular aluminum strips, and wherein the top and bottom walls, baffle shelf and fan shelf and exhaust duct additionally are lined with 1 inch foam, and wherein additional layers of $\frac{1}{2}$ inch and $\frac{1}{4}$ inch foam are interposed between the $\frac{1}{4}$ inch and 1 inch foam on the top wall.

9. The fogger apparatus of claim 5, wherein the nozzle assembly comprises a multiple layer, thin, rectangular nozzle head and filter box, comprising a first lower oil sump chamber, an oil intake manifold at the bottom of the chamber, the oil intake manifold having vertically-oriented oil line connectors and oil filters horizontally-extending into the oil manifold, a site glass connected to a side of the oil sump chamber, an opening in the top of the oil sump chamber, oil tubes connected to the oil line connectors on the manifold and extending upward through the opening in the top of the oil sump chamber, a nozzle chamber, an opening in a bottom of the nozzle chamber aligned with the opening in the top of the oil sump chamber, an air manifold positioned in the nozzle chamber, a plurality of nozzles having inlets connected to the air manifold and having spray nozzle outlets, and having oil inlets on the nozzles between the air inlets and the spray nozzles, the oil lines being connected to the oil inlets for drawing oil through the filters and oil manifold and oil lines into the nozzles, with air flowing through the nozzles from the air manifold, the nozzle chamber having a cover, a small opening in the cover aligned with the air manifold and a compressed air connector connected to the air manifold through the small opening, a nozzle access hole in the nozzle chamber cover near the small hole for accessing the nozzles, a mist flow hole in the cover remote from the nozzle access hole for flowing mist upward through the cover, a marble maze chamber positioned above the nozzle chamber, the marble maze chamber having side walls and a bottom wall with a plurality of openings above the mist opening in the nozzle chamber for flowing mist through the plurality of openings, marbles disposed in the marble chamber, a cover on the marble chamber having a mist-releasing opening at an end of the chamber opposite the plural mist-flowing openings in the bottom of the marble chamber, a filter chamber positioned above the marble chamber, the filter chamber having plural marble-restricting openings in a bottom wall and a mist-releasing opening in a top wall at a position thereon remote from the marble-restricting openings in the bottom wall, and a mist exhaust connected to the opening in the top wall of the filter chamber.

10. The apparatus of claim 9, further comprising vertically extending bolts extending downward through the filter chamber, through the marble chamber, through the nozzle chamber and through the cover of the oil sump chamber and holding the chambers vertically assembled together.

11. The apparatus of claim 9, further comprising a handle connected to the bolts and positioned on the cover of the filter chamber for lifting and carrying the assembly.

12. The apparatus of claim 9, further comprising bolts extending through the filter chamber, through the marble chamber, through the nozzle chamber and through part of the oil sump chamber and holding the chambers assembled together.

13. The apparatus of claim 12, further comprising a handle connected to the bolts and positioned on the filter chamber for lifting and carrying the mist head assembly.

14. Fogger apparatus comprising a multiple layer, thin, rectangular nozzle head and filter box, comprising a first lower oil sump chamber, an oil intake manifold at the bottom of the chamber, the oil intake manifold having vertically-oriented oil line connectors and oil filters horizontally-extending into the oil manifold, a site glass connected to a side of the oil sump chamber, an opening in the top of the oil sump chamber, oil tubes connected to the oil line connectors and extending upward through the opening in the top of the oil sump chamber, a nozzle chamber, an opening in a bottom of the nozzle chamber aligned with the opening in the top of the oil sump chamber, an air manifold positioned in the nozzle chamber, a plurality of nozzles having inlets connected to the air manifold and having spray nozzle outlets, and having oil inlets on the nozzles between the air inlets and the spray nozzles, the oil lines being connected to the oil inlets for drawing oil through the filters and oil manifold and oil lines into the nozzles, with air flowing through the nozzles from the air manifold, the nozzle chamber having a small opening aligned with the air manifold and a compressed air connector connected to the air manifold through the small opening, a nozzle access hole in the nozzle chamber near the small hole for accessing the nozzles, a mist flow hole remote from the nozzle access hole for flowing mist outward, a marble maze chamber positioned adjacent the nozzle chamber, the marble maze chamber having a plurality of openings adjacent the mist opening in the nozzle chamber for flowing mist through the plurality of openings, marbles disposed in the marble chamber, the marble chamber having a mist-releasing opening at an end of the chamber opposite the plural mist-inflow openings in the marble chamber, a filter chamber positioned adjacent the marble chamber, the filter chamber having plural marble-restricting openings in a wall and a mist-releasing opening in a wall at a position thereon remote from the marble-restricting openings wall, and a mist exhaust connected to the mist-releasing opening in the top wall of the filter chamber.

15. Fog head apparatus comprising a compressed air connector, an air manifold connected to the compressed air connector for receiving compressed air from the connector, plural venturi spray nozzles having inlets connected to the air manifold, having suction ports and having spray nozzle head outlets, oil supply lines connected to the suction ports, a nozzle chamber surrounding the nozzles and a maze chamber connected to the nozzle chamber for passing oil mist sprayed from the spray nozzle heads through the maze, the maze chamber having an outlet, and a filter chamber having an inlet connected to the outlet of the maze chamber, the filter chamber having a foam filter and a mist outlet port connected to the filter chamber remote from the filter chamber inlet.

16. The apparatus of claim 15, further comprising an oil sump positioned beneath the nozzles, oil in the sump, an oil manifold in the oil, the oil manifold having connections connected to the oil lines and having intake ports and intake filters connected to the intake ports of the oil manifold.

17. The apparatus of claim 15, further comprising a fog duct surrounding the mist port, air inlet means in the fog duct adjacent the mist port and fog outlet means in the fog duct remote from the mist port and the air inlet means for entraining mist in the air flowing through the inlet port and outlet port for flowing a fog to a desired location.

18. The apparatus of claim 17, further comprising a fan chamber connected to the air inlets, fans within the fan chamber, and a fan intake baffle chamber connected to the fan chamber and inlet means in the baffle chamber remote from the fan chamber for flowing air inward through the baffle chamber into the fan chamber and out through the openings in the fog duct.

19. The apparatus of claim 18, further comprising an air compressor mounted in a compressor chamber adjacent the fan chamber, an outlet on the air compressor connected to a compressed air connector on the air manifold, air exhaust outlets near the compressor for flowing air from the fan chamber around the compressor and out through the outlets.

20. The apparatus of claim 19, further comprising exhaust ducts mounted between the compressor and the air exhaust outlets and a heat exchanger mounted near the exhaust ducts and connected in the compressed air line between the air compressor and the compressed air connector for removing heat from the compressed air in the heat exchanger with air moving through the exhaust ducts.

21. The apparatus of claim 20, further comprising a road case having insulated walls surrounding and forming the baffle chamber, the fan chamber, the mist duct, the compressor chamber and the exhaust duct.

22. The apparatus of claim 21, further comprising a power cord having a 110 volt AC plug connected to the road case, a switch connected to the power cord, the power cord being connected to the fans and to the air compressor for turning on the air compressor and fans when the switch is turned on for creating and delivering fog by providing compressed air to the venturi nozzle array, drawing oil from the sump with the compressed air flowing through the nozzles, spraying the oil in a fine mist with the nozzles and decompressed air, turning and filtering the mist and mixing the mist with air currents from the fans and carrying the mist with the fan-blown air currents.

23. A mist head assembly comprising a plurality of chambers, a first chamber being an oil sump chamber having oil intake means, a second chamber being a nozzle chamber adjacent the first chamber and having a plurality of spray nozzles with receiving means for air and receiving means for oil, and having a mist flow hole for allowing mist to flow from the nozzle chamber, a maze chamber positioned adjacent to the nozzle chamber having a plurality of openings for receiving mist, and having means for collection of large mist particles and passage of finer mist particles, and having an opening for releasing the mist from the maze chamber, a filter chamber positioned adjacent to the maze chamber having a plurality of openings for receiving mist from the maze chamber and having a mist releasing opening, the entire mist head assembly being assembled together as one unit.

24. A mist head assembly comprising a vertical assembly of chambers, a first lower chamber being an oil sump chamber, an oil intake manifold at the bottom of the oil sump chamber, the oil intake manifold having vertically orientated oil line connectors and oil filters horizontally extending into the oil manifold, a sight glass connected to a side of the oil sump chamber, an opening in the top of the oil sump chamber, oil tubes connected to the oil line connectors on the manifold and extending upward through the opening in the top of the oil sump chamber, a nozzle chamber atop and adjacent to the oil sump chamber, an opening in a bottom of the nozzle chamber aligned with the opening in the top of the oil sump chamber, an air manifold positioned in the nozzle chamber, a plurality of nozzles having inlets connected to the air manifold and having spray nozzle outlets, and having oil inlets on the nozzles between the air inlets and the spray nozzles, the oil lines being connected to the oil inlets for drawing oil through the filters and oil manifold and oil lines into the nozzles, with air flowing through the nozzles from the oil manifold, the nozzle chamber having a small opening aligned with the air manifold and a compressed air quick coupling connector connected to the air manifold through the small opening, a nozzle access hole in the nozzle chamber near the small hole for accessing the nozzles, a mist flow hole remote from the nozzle access hole for flowing mist outward, a marble maze chamber positioned atop and adjacent the nozzle chamber, the marble maze chamber having a plurality of openings adjacent the mist opening in the nozzle chamber for flowing mist through the plurality of openings, marbles disposed in the marble chamber, the marbles being balls of a hard material that does not absorb oil, the marble chamber having a mist releasing opening at an end of the chamber opposite the plurality of mist inflow openings in the marble chamber, a filter chamber positioned atop and adjacent to the marble chamber, the filter chamber having plural marble restricting openings in a wall and a mist releasing opening in a wall at a position thereon remote from the marble restricting opening wall, and a mist exhaust connected to the mist releasing opening in the top wall of the filter chamber, bolts extending through the filter chamber, through the marble chamber, through the nozzle chamber and through parts of the oil sump chamber and holding the chambers assembled together, a handle connected to the bolts and positioned on the filtered chamber for lifting the carrying the entire mist head assembly as one unit to be easily removed from or installed within a fogger assembly.

* * * * *